US011172757B2

(12) United States Patent
Scharfenkamp et al.

(10) Patent No.: US 11,172,757 B2
(45) Date of Patent: Nov. 16, 2021

(54) TABLE ASSEMBLY WITH REVERSIBLE LEG ASSEMBLIES

(71) Applicant: SMITH SYSTEM MANUFACTURING COMPANY INC., Carrollton, TX (US)

(72) Inventors: Robert Scharfenkamp, Prosper, TX (US); Michael Risdall, Minneapolis, MN (US); Jack Wayne Johnson, McKinney, TX (US); Matthew Dewey, Plano, TX (US)

(73) Assignee: Smith System Manufacturing Company, Inc., Carrollton, TX (US)

( * ) Notice: Subject to any disclaimer, the term of this patent is extended or adjusted under 35 U.S.C. 154(b) by 0 days.

(21) Appl. No.: 16/826,804

(22) Filed: Mar. 23, 2020

(65) Prior Publication Data

US 2021/0289937 A1 Sep. 23, 2021

(51) Int. Cl.

| | |
|---|---|
| ***A47B 91/00*** | (2006.01) |
| ***A47B 9/14*** | (2006.01) |
| ***A47B 9/20*** | (2006.01) |
| ***A47B 13/02*** | (2006.01) |

(52) U.S. Cl.

CPC ..... *A47B 9/14* (2013.01); *A47B 9/20* (2013.01); *A47B 13/021* (2013.01); *A47B 2009/145* (2013.01); *A47B 2013/022* (2013.01); *A47B 2200/0017* (2013.01); *A47B 2200/0032* (2013.01); *A47B 2200/0052* (2013.01)

(58) Field of Classification Search

CPC ... A47B 13/021; A47B 2013/022; A47B 9/14; A47B 2009/145; A47B 91/028; A47B 2200/0017; A47B 2200/0032; A47B 2200/0052; B60B 33/0002; B60B 33/0005

See application file for complete search history.

(56) References Cited

U.S. PATENT DOCUMENTS

| | | | |
|---|---|---|---|
| 730,466 | A | 6/1903 | Maass |
| 1,863,761 | A | 6/1932 | Neuwirth |

(Continued)

FOREIGN PATENT DOCUMENTS

| | | | |
|---|---|---|---|
| AU | 2016202281 | A1 | 11/2016 |
| CA | 3055794 | | 3/2019 |

(Continued)

*Primary Examiner* — Matthew W Ing

(74) *Attorney, Agent, or Firm* — Price Heneveld LLP

(57) ABSTRACT

A leg assembly for a table includes a support that is configured to couple to a table worksurface. A leg member engages the support and is movable with respect to the support such that the leg assembly is configured to support the table worksurface above a floor surface. A first friction reduction member is attached to a first end of the leg member. A second friction reduction member is configured to attach to a second end of the leg member. The first and second ends are configured to alternately engage the support from one another such that the leg member is reversibly received by the support and such that the first friction reduction member abuts the floor surface when the second end of the leg member engages the support, and the second friction reduction member abuts the floor surface when the first end of the leg member engages the support.

21 Claims, 8 Drawing Sheets

(56) References Cited

U.S. PATENT DOCUMENTS 2,103,202 A * 12/1937 Green ..... A47B 91/02 16/19
2,527,180 A 10/1950 Evens
2,612,335 A 9/1952 Saltzman
3,315,621 A 4/1967 Szymber
3,869,105 A * 3/1975 Daniels ..... A47B 91/00 248/188.8
4,662,591 A * 5/1987 Encontre ..... A47B 13/021 108/158
4,731,900 A * 3/1988 Frobose ..... B60B 33/0002 16/38
5,096,186 A 3/1992 Wilkinson et al.
5,107,775 A 4/1992 Langlais et al.
5,562,052 A 10/1996 Glashouwer et al.
5,706,741 A 1/1998 Thorp et al.
6,354,231 B1 * 3/2002 Morris ..... A47B 91/028 108/144.11
6,598,841 B2 7/2003 Erickson et al.
6,796,001 B1 * 9/2004 Finkelstein ..... B60B 33/0002 16/19
D499,585 S 12/2004 Williams et al.
6,880,709 B2 4/2005 Chen
7,159,829 B1 1/2007 Finkelstein
7,165,361 B2 1/2007 Vanagan
7,168,373 B1 1/2007 Hock
7,246,779 B2 7/2007 Doyle
7,571,887 B2 * 8/2009 Finkelstein ..... B60B 33/04 248/188.4
8,118,375 B2 2/2012 Berthiaume et al.
8,186,284 B2 5/2012 Westbrook et al.
9,523,381 B1 * 12/2016 Carpinella ..... B60B 33/001
9,995,328 B2 6/2018 Gregory
D826,611 S 8/2018 Fletcher
2006/0260516 A1 * 11/2006 Chow ..... A61G 13/105 108/14
2007/0151490 A1 * 7/2007 Pflaster ..... A47B 83/04 108/180
2008/0156759 A1 7/2008 Lai
2008/0241814 A1 10/2008 Seidl
2017/0303678 A1 10/2017 Palazeti

FOREIGN PATENT DOCUMENTS

CN 106942890 A 7/2017
CN 107865517 A 4/2018
CN 108741658 A 11/2018
DE 20311660 U1 11/2003
DE 102005007363 A1 9/2006
GB 308685 5/1930
JP 2001104078 A 4/2001
JP 2001149142 A 6/2001

* cited by examiner

TABLE ASSEMBLY WITH REVERSIBLE LEG ASSEMBLIES

BACKGROUND

The present disclosure generally relates to a table assembly with leg assemblies configured to adjustably support a worksurface above a floor surface, the leg assemblies being reconfigurable between varying floor-engagement configurations and adjustable between varying height configurations.

SUMMARY OF THE DISCLOSURE

The leg assembly for a table assembly as disclosed herein may include an upper tube that is configured to couple to a table worksurface, a lower tube telescopingly coupled to the upper tube, the lower tube having first and second ends that are each configured to be alternately received within the upper tube from one another, a glide coupled to the first end of the lower tube and configured to abut a floor surface when the second end of the lower tube is received within the upper tube, and a wheel configured to couple to the second end of the lower tube such that the wheel is configured to abut the floor surface when the first end of the lower tube is received within the upper tube and the wheel is coupled to the second end of the lower tube.

The leg assembly for a table assembly may also or alternatively include a support that is configured to couple to a table worksurface, a leg member engaging the support and movable between a first position where the leg member is configured to support the table worksurface at a first height and a second position wherein the leg member is configured to support the worksurface at a second height that is different than the first height, a first friction reduction member attached to a first end of the leg member, and an attachment member attached to a second end of the leg member and configured to attach a second friction reduction member to the second end of the leg member, wherein the first end and the second end of the leg member are alternately engagable with the support from one another.

The leg assembly for a table assembly may further or alternatively include a support configured to couple to a table worksurface, a leg member engaging the support and movable with respect to the support such that the leg assembly is configured to support the table worksurface above a floor surface, a first friction reduction member attached to a first end of the leg member, a second friction reduction member configured to attach to a second end of the leg member, wherein the first and second ends are configured to alternately engage the support from one another such that the leg member is reversibly received by the support and such that the first friction reduction member abuts the floor surface when the second end of the leg member engages the support and the second friction reduction member abuts the floor surface when the first end of the leg member engages the support.

These and other features, advantages, and objects of the present disclosure will be further understood and appreciated by those skilled in the art by reference to the following specification, claims, and appended drawings.

The components in the figures are not necessarily to scale, emphasis instead being placed upon illustrating the principles described herein.

DETAILED DESCRIPTION

Figure 1:
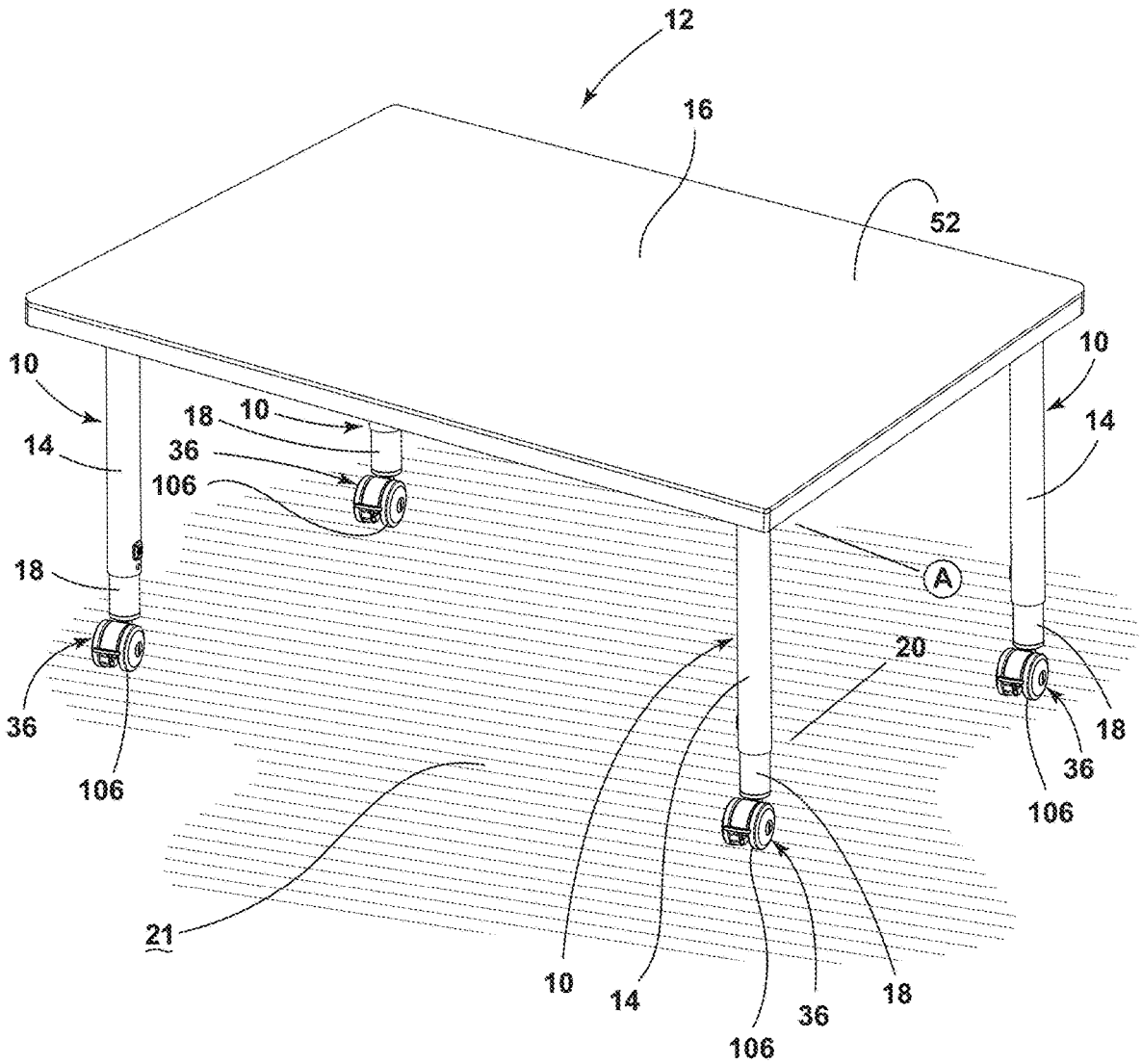
FIG. 1 is a top perspective view of a table assembly on a floor surface of the present disclosure at a first height.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
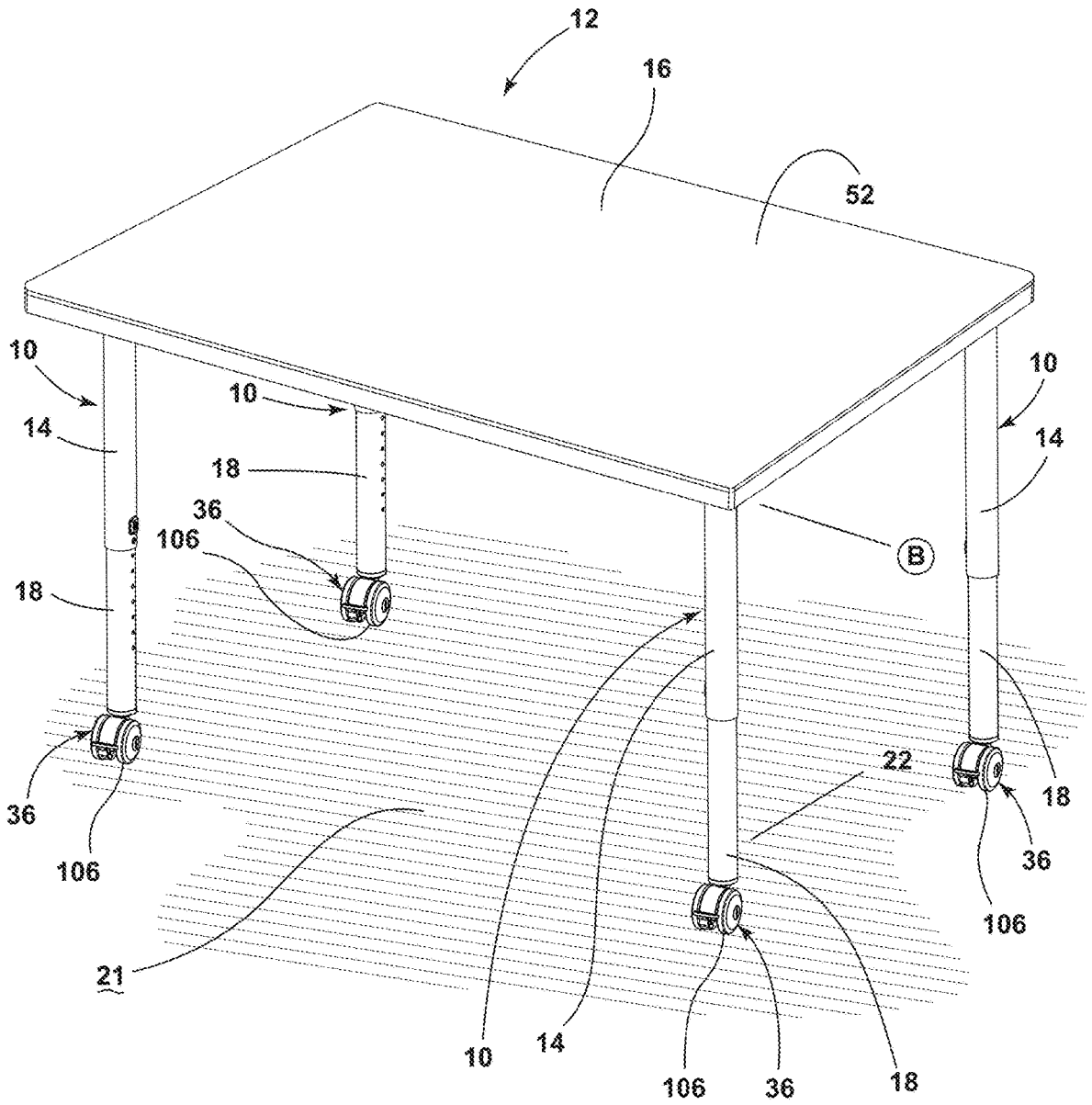
FIG. 2 is a top perspective view of a table assembly on a floor surface of the present disclosure at a second height.
Figure 3:
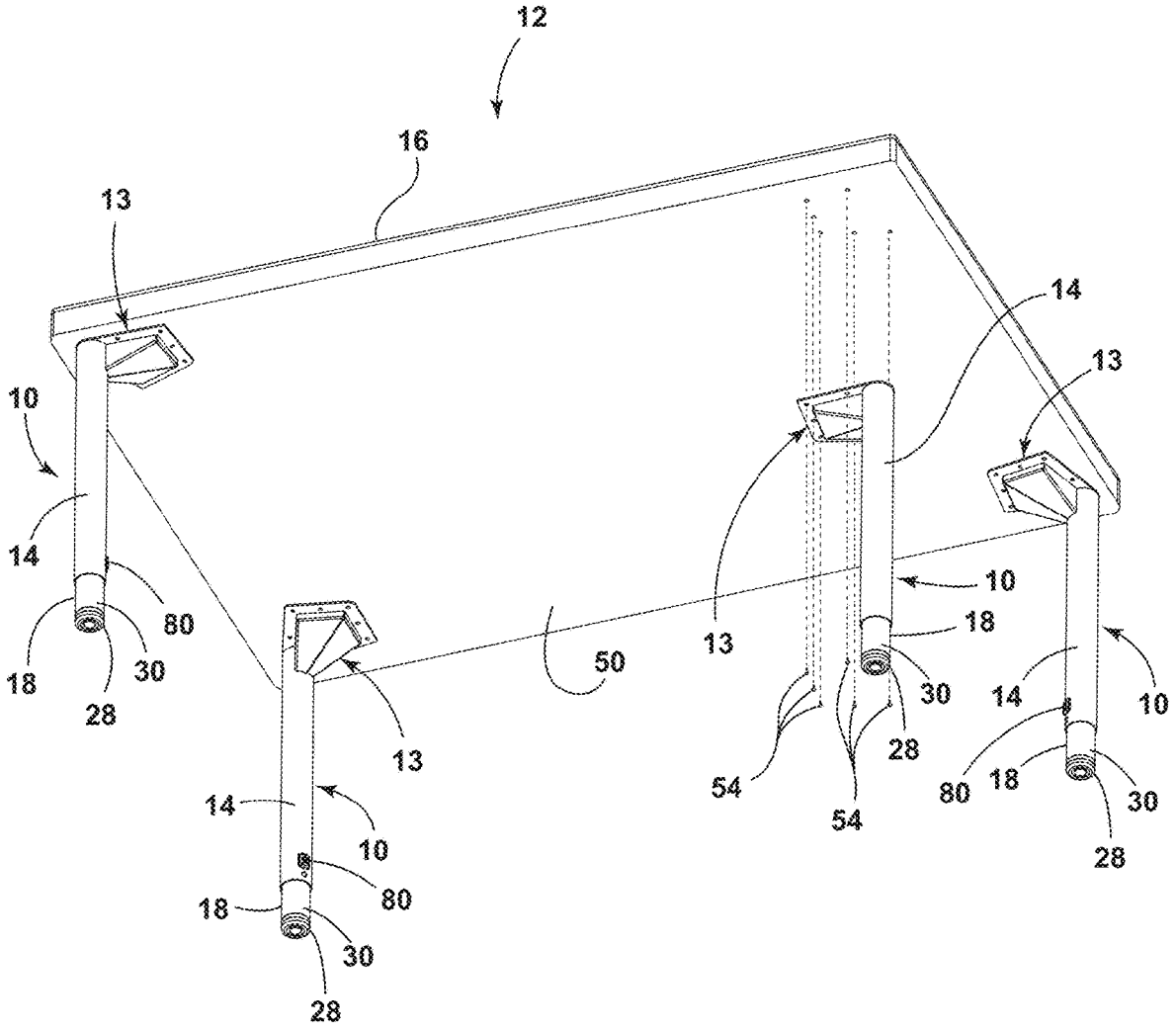
FIG. 3 is a bottom perspective view of a table assembly of the present disclosure.
Figure 7:
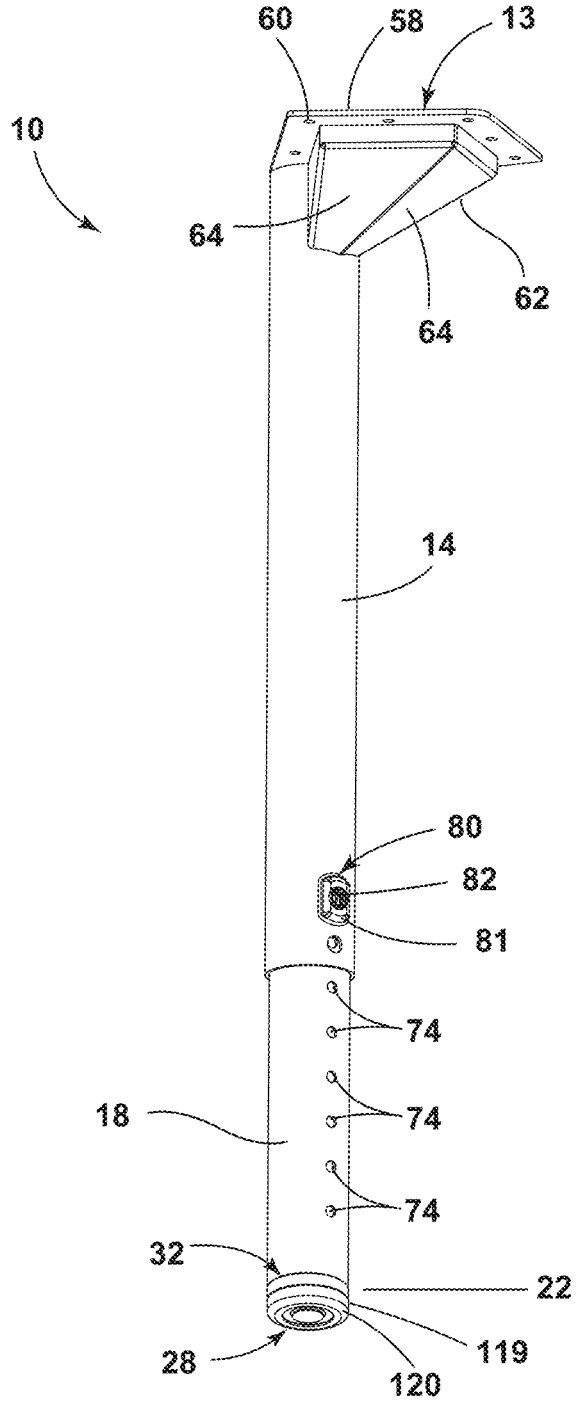
FIG. 7 is a side perspective view of the leg assembly in a second or reversed configuration.

The reference numeral 10 (FIGS. 1-3) generally designates a leg assembly for a table assembly 12. In the illustrated example, the table assembly 12 includes four leg assemblies 10, each leg assembly 10 including a mounting bracket 13 coupled to the table worksurface 16, a support 14 configured to couple to a table worksurface 16 via the mounting bracket 13, and a leg member 18 that engages the support 14. Additionally or alternatively, the support 14 may be referred to as an upper tube, outer tube or upper leg, and the leg member 18 may be referred to as a lower tube, inner tube or lower leg. The lower leg 18 is movable between a first position 20 (FIGS. 1 and 4) where the leg assembly 10 is configured to support the table worksurface 16 at a first height A above a floor surface 21, and a second position 22 (FIGS. 2 and 7) where the leg assembly 10 is configured to support the table worksurface 16 at a second height B that is different than the first height A.

Figure 8:
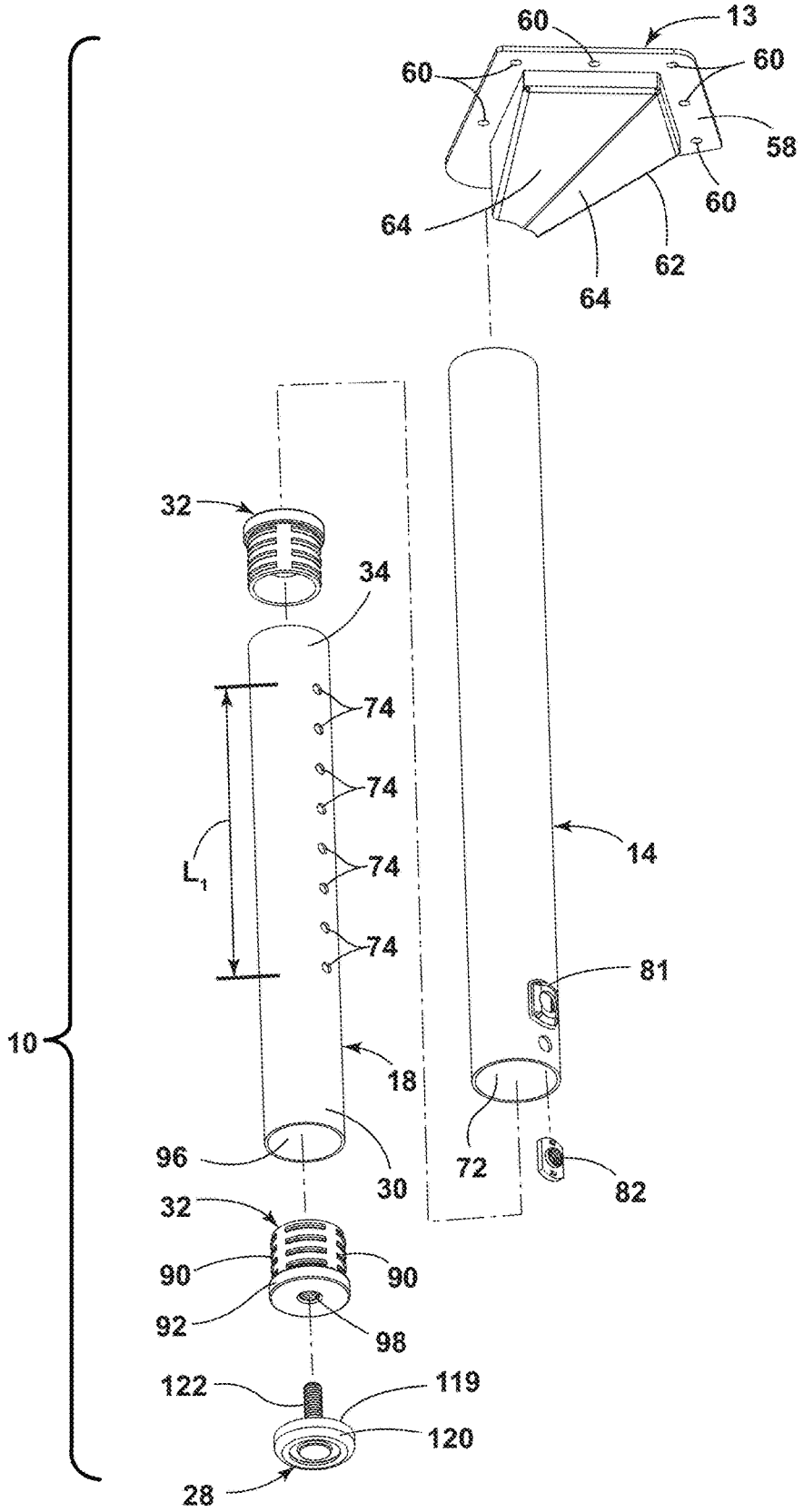
FIG. 8 is an exploded perspective view of the leg assembly in the second configuration.

The leg assembly 10 (FIGS. 1, 7, and 8) may also include a first friction reduction member 28 attached to a first end 30 of the lower leg 18 via an attachment member 32 received within the first end 30 of the lower leg 18, and a second friction reduction member 36 (FIGS. 1, 4, and 5) attached to a second end 34 of the lower leg 18 via a second attachment member 32 received within the second end 34 of the lower leg 18. In the illustrated example, the first friction reduction member 28 includes a glide 119 (FIGS. 7 and 8) configured to allow the table assembly 12 to easily slide, move or otherwise be repositioned across the floor surface 21, while the second friction reduction member 36 includes a caster assembly 106 (FIGS. 4-6), the first and second friction reduction members 28, 36 being further described below.

Referring to FIGS. 1-4, the table assembly 12 includes the table worksurface 16 supported by, in the illustrated example, four of the leg assemblies 10; however, more or fewer legs may be utilized depending upon the configuration of the table worksurface 16. The table worksurface 16 may include a bottom surface 50 and an upper surface 52, and may be comprised of wood, polymer material, metal, and other materials typically known in the art for use as worksurfaces, and combinations thereof.

Each leg assembly 10 include the mounting bracket 13 (FIGS. 3, 4 and 6) attached to the bottom surface 50 of the table worksurface 16 via a plurality of self-tapping mounting screws 54 or other suitable fasteners. In the illustrated example, the mounting bracket 13 includes an attachment plate 58 that includes a plurality of attachment apertures 60 spaced about a perimeter of the attachment plate 58 where the apertures 60 are configured to receive the screws 54. The mounting bracket 13 may also include a base 62 extending downward from the attachment plate 58 and coupled to the upper leg 14 via welding, mechanical fasteners, and/or other methods of attachment known in the art. The base 62 may include a plurality of angular surfaces 64 configured to disperse a load from the table worksurface 16 along the leg assembly 10.

Referring now to FIGS. 4-8, the upper leg 14 and the lower leg 18, as illustrated, each have a tubular shape with a circular cross-section. It is also contemplated that the upper leg 14 and the lower leg 18 may have any cross-sectional shape conducive to movement of the lower leg 18 inward and outward of the upper leg 14. The upper leg 14 may telescopingly receive the lower leg 18 within a receiving cavity 72 of the upper leg 14, thereby allowing for the lower leg 18 to slidably engage the upper leg 14.

The leg assembly 10 may further include a lock 80 (FIGS. 4-6) configured to lock the lower leg 18 at a plurality of preselected telescoping positions with respect to the upper leg 14. In the illustrated example, the lower leg 18 includes a plurality of apertures 74 spaced along a length $L_1$, which generally corresponds to at least the first and second heights A, B. A user may telescopingly adjust the lower leg 18 relative to the upper leg 14 to achieve the selected first and/or second height A, B. The lock 80 may also include an outwardly-extending pocket relief 81 located along a length of the upper leg 14, a threaded nut 82 welded to the upper leg 14 within the present pocket relief 81, and a lock member 84 threadably received within the nut 82. In operation, the lower leg 18 may be repositioned or moved with respect to the upper leg 14 by unthreading the lock member 84 from the threaded nut 82 until the lock member 84 no longer extends through the selected aperture 74. The lower leg 18 is then telescopingly moved or adjusted with respect to the upper leg 14 until a different selected aperture 74 is aligned with the lock member 84. The lock member 84 can then be threaded into the threaded nut 82 to engage the newly selected aperture 74.

The attachment members 32 (FIGS. 4-8) may be disposed within either the first end 30 and/or the second end 34 of the leg member 18. The attachment members 32 may be configured to couple the first friction reduction member 28 and/or the second friction reduction member 36 to the first and second ends 30, 34 of the leg member 16. In the illustrated example, each attachment member 32 includes a plurality of retention ridges 90 spaced along a body 92 of each attachment member 32. The attachment member 32 is configured to engage an interior sidewall 94 of the lower leg 18 to thereby retain the attachment member 32 within a cavity 96 of the lower leg 18. Each attachment member 32 may also include a threaded opening 98 configured to couple the first and/or second friction reduction member 28, 36 as described below. In the illustrated example, the attachment member 32 that couples to the first friction reduction member 28 is disposed within the first end 30 of the leg member 18, and the attachment member 32 to that couples to the second friction reduction member 36 is disposed within the second end 34 of the leg member 18.

As noted above, in the illustrated example of the second friction reduction member 36 includes the caster assembly 106 coupled to the second end 34 of the leg member 18 via one of the attachment members 32. While the illustrated example of the second friction reduction member 36 comprises the caster assembly 106, it is noted that other suitable friction reduction arrangements could be utilized in place of or in addition to the caster assembly 106, including non-pivoting wheels, rollers, bearings, friction-reducing or slip surfaces, e.g., smooth plastic surfaces and/or oil-filled plastics/nylon, or other suitable arrangements. The second friction reduction member 36 provides minimal frictional resistance for the leg assembly 10, and ultimately the table assembly 12, such that the table assembly 12 may be easily moved or repositioned across the floor surface 21. The caster assembly 106 may also include a lock assembly 108, such that once the table assembly 12 has been repositioned, the wheel 107 may be locked from rotation.

In the illustrated example, the second friction reduction member 36, illustrated as a caster assembly 106, includes a threaded shaft 104 configured to threadably couple to the threaded opening 98 of the associated attachment member 32. The first friction reduction member 28 may include the glide 119 (FIGS. 5, 6 and 8) that has a base 120 configured to allow the table assembly 12 to easily slide, move, or otherwise be repositioned across the floor surface 21. The base 120 may comprise a smooth plastic or metal surface, and/or an oil-filled plastic/nylon, or other suitable materials, and surface configurations. In the illustrated example, the glide 119 includes a threaded shaft 122 extending from the base 120 and configured to threadably couple to the threaded opening 98 of the associated attachment member 32. It is also contemplated that the glide 119 can attach to either the attachment member 32 or the first end 30 of the leg member 18 via a press-fit, a snap connection, an adhesive, or combinations thereof.

Figure 4:
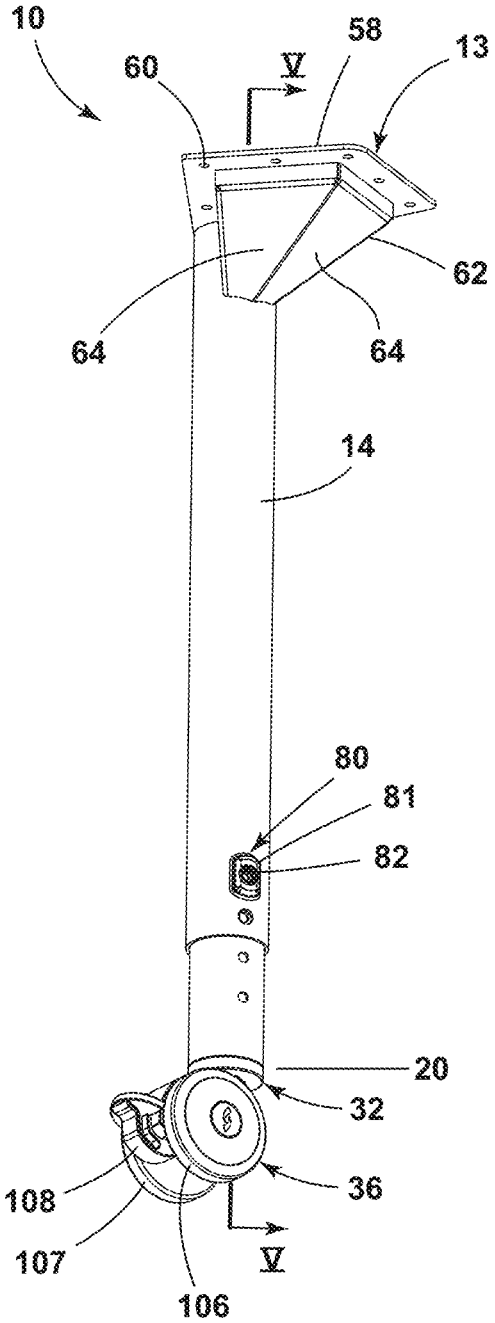
FIG. 4 is a side perspective view of a leg assembly in a first configuration.
Figure 5:
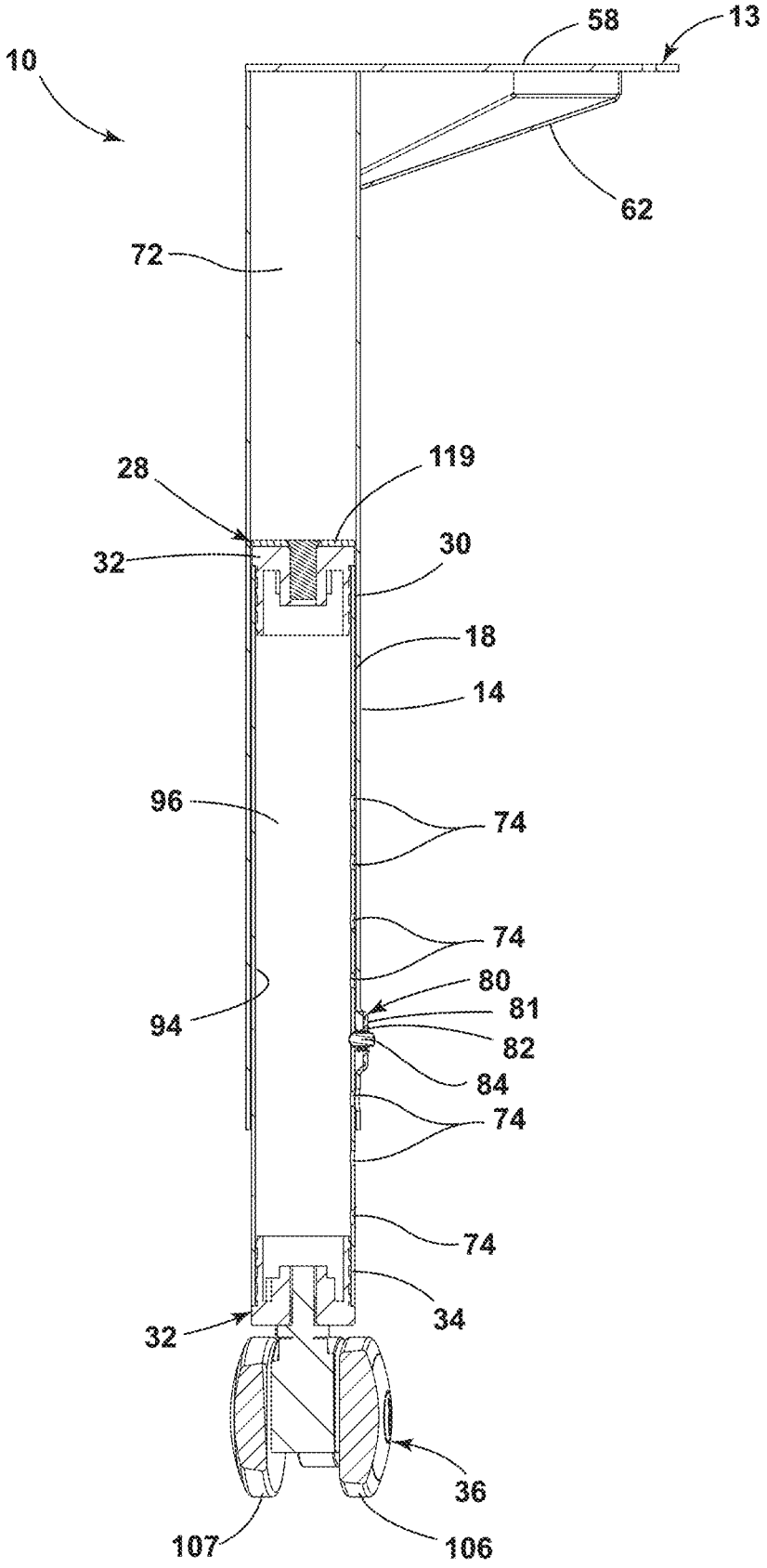
FIG. 5 is a cross-sectional elevational view of the leg assembly taken along the line V-V, FIG. 4.
Figure 6:
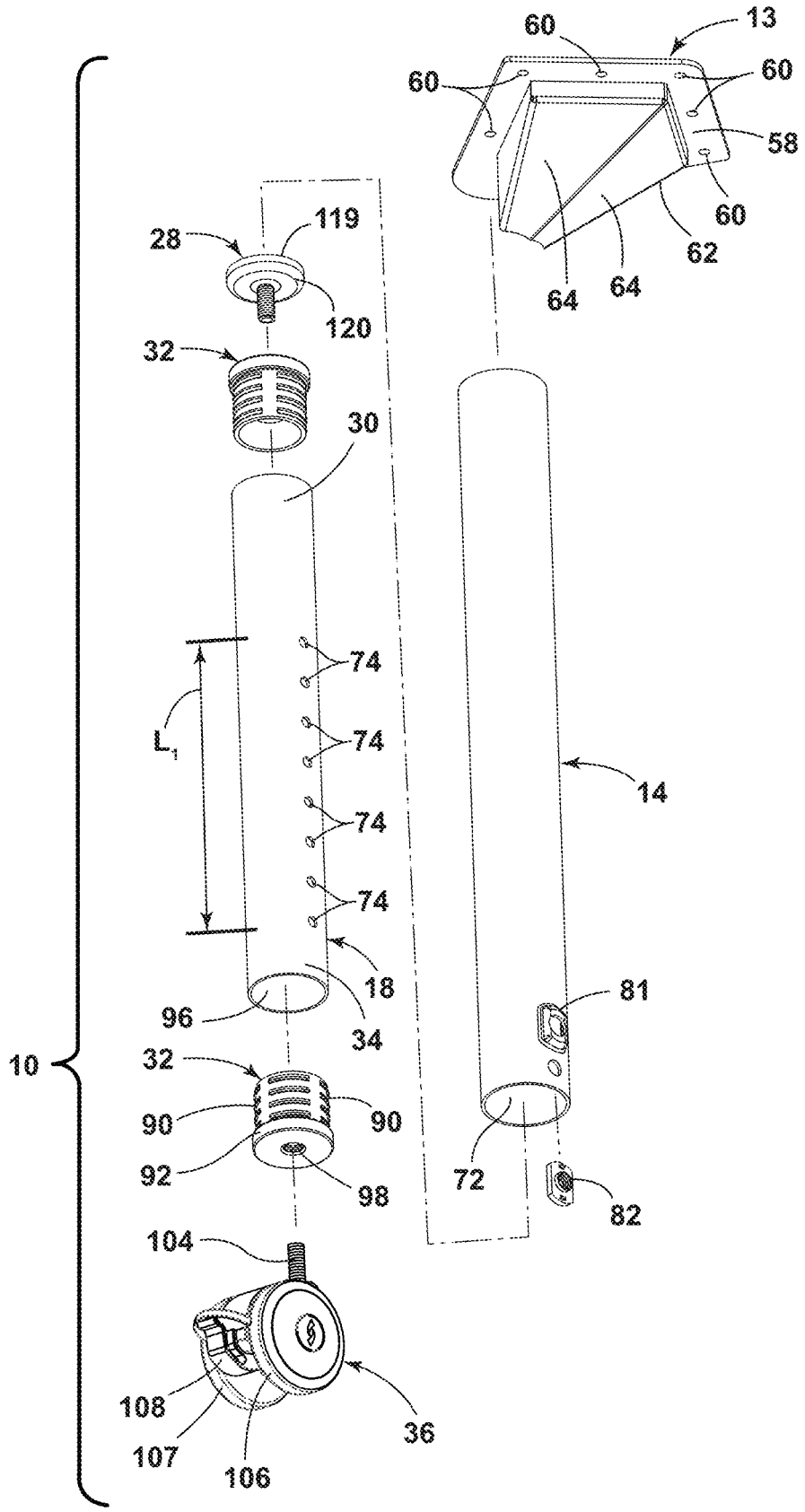
FIG. 6 is an exploded perspective view of the leg assembly.

As noted above, the lower leg 18 is configured to be reversibly disposed within the upper leg 14, such that either the first end 30 or the second end 34 can be positioned within the upper leg 14. As illustrated in FIGS. 4 and 5, the first end 30 of the lower leg 18 may be disposed within the upper leg 14 in a first configuration, such that the first friction reduction member 28 is in a stowed position, and the second end 34 of the lower leg 18 is positioned distally from the upper leg 14, such that the second friction reduction member 36 abuts the floor surface 21.

In the illustrated example, the configuration of the glide 119 allow the glide 119 to be disposed or stored within the receiving cavity 72 of the upper leg 14 without removing or uncoupling the glide 119 from engagement with the attachment member 32. In a second configuration of the leg assembly 10 (FIGS. 7 and 8) the second end 34 of the lower leg 18 may be disposed within the upper leg 14, such that the first friction reduction member 28 abuts the floor surface 21. In the illustrated example, the caster assembly 106 is uncoupled from the attachment member 32, thereby allowing the attachment member 32 and the second end 34 to be received within the upper leg 14.

In order to interchangeably utilize either or both of the first and second friction reduction members 28, 36, a user removes either the first end 30 or the second end 34 of the lower leg 18 from engagement with the upper leg 14, reorients the lower leg 18 with respect to the upper leg 14, and then engages the opposite end 30, 34 within the receiving cavity 72 of the upper leg 14. For example, if the leg assembly 10 is in the first configuration, such that the caster assembly 106 is positioned to support the table assembly 12, the lower leg 18 may be removed from engagement with the upper leg 14 by disengaging the lock 80 and sliding lower leg 18 from the upper leg 14. The caster assembly 106 may then be removed from engagement with the attachment member 32 located in the second end 34 of the lower leg 18, and the second end 34 of the lower leg 18 can be inserted into the receiving cavity 72 of the upper leg 14 such that the glide 119 supports the table assembly 12.

The leg assembly and the table assembly as described herein provide useful adjustment between varying friction-reducing supports while simultaneously allowing for the adjustable support of an associated worksurface at various vertical heights. The leg assembly and associated table assembly consolidate the various parts used with differing friction reducing members, such as casters, wheels, glides and the like. By stowing either end of the leg member within the support, the parts are contained and remain generally intact even in the storage or stowed position. Moreover, the leg member with the attachment feature provides the optional arrangement of either of the friction reduction members.

In the foregoing description, it will be readily appreciated by those skilled in the art that modifications may be made to the described embodiments without departing from the concepts disclosed herein. Such modifications are to be considered as included in the following claims, unless these claims by their language expressly state otherwise.

The invention claimed is:

1. A leg assembly for a table assembly, comprising:
an upper tube configured to couple to a table worksurface;
a lower tube telescopingly coupled to the upper tube, the lower tube having first and second ends each configured to be alternately received within the upper tube from one another;
a glide coupled to the first end of the lower tube and configured to abut a floor surface when the second end of the lower tube is received within the upper tube; and
a wheel configured to couple to the second end of the lower tube such that the wheel is configured to abut the floor surface when the glide and the first end of the lower tube are received within the upper tube and the wheel is coupled to the second end of the lower tube.

2. The leg assembly of claim 1, wherein the upper tube and the lower tube each have a circular cross-sectional shape.

3. The leg assembly of claim 1, wherein the leg assembly includes a caster assembly that includes the wheel.

4. The leg assembly of claim 1, further comprising:
a mounting bracket configured to couple to the table worksurface, and wherein the upper tube is attached to the mounting bracket.

5. The leg assembly of claim 1, further comprising:
a lock configured to lock the lower tube at a plurality of preselected positions with respect to the upper tube.

6. The leg assembly of claim 5, wherein the lock includes a lock member that threadably engages one or more apertures of the upper tube and/or the lower tube.

7. The leg assembly of claim 1, wherein the lower tube is telescopingly movable between a first position where the leg assembly is configured to support the table worksurface at a first height and a second position wherein the leg assembly is configured to support the table worksurface at a second height that is different than the first height.

8. A table assembly comprising the leg assembly of claim 1 coupled to the table worksurface.

9. A leg assembly for a table assembly, comprising:
a support configured to couple to a table worksurface;
a leg member engaging the support and movable between a first position where the leg member is configured to support the table worksurface at a first height and a second position wherein the leg member is configured to support the worksurface at a second height that is different than the first height;
a first friction reduction member attached to a first end of the leg member; and
an attachment member attached to a second end of the leg member and configured to attach a second friction reduction member to the second end of the leg member;
wherein the first end and the second end of the leg member are alternately engagable with the support from one another, and wherein the first friction reduction member remains attached to the first end of the leg member when the first end is engaged with the support.

10. The leg assembly of claim 9, wherein the support includes a receiving cavity that telescopingly receives the leg member.

11. The leg assembly of claim 9, further comprising:
a mounting bracket configured to couple the support to the table worksurface.

12. The leg assembly of claim 9, wherein the first and second ends of the leg assembly are alternatively engagable with the support between a first configuration where the first end is coupled to the support and the second end located distally from the support and a second configuration where the second end is coupled to the support and the first end is located distally from the support.

13. The leg assembly of claim 12, wherein the first friction reduction member includes a glide configured to abut a floor surface when the leg member is in the second configuration.

14. The leg assembly of claim 12, wherein the second friction reduction member includes a wheel coupled to the attachment member, where the wheel is configured to abut a floor surface when the leg member is in the first configuration.

15. A table assembly comprising the leg assembly of claim 9 coupled to the table worksurface.

16. The leg assembly of claim 9, further comprising:
a lock configured to lock the leg member at a plurality of preselected positions with respect to the support.

17. A leg assembly for a table assembly, comprising:
a support configured to couple to a table worksurface;
a leg member engaging the support and movable with respect to the support such that the leg assembly is configured to support the table worksurface above a floor surface;
a first friction reduction member attached to a first end of the leg member; and
a second friction reduction member configured to attach to a second end of the leg member; and
a lock configured to lock the leg member at a plurality of preselected positions with respect to the support;

wherein the first and second ends are configured to alternately engage the support from one another such that the leg member is reversibly received by the support and such that the first friction reduction member abuts the floor surface when the second end of the leg member engages the support and the second friction reduction member abuts the floor surface when the first end of the leg member engages the support.

18. The leg assembly of claim 17, wherein the support telescopingly receives the leg member.

19. The leg assembly of claim 17, further comprising:

an attachment member coupled to the second end of the leg member, wherein the attachment member is configured to attach the second friction member to the second end of the leg member.

20. The leg assembly of claim 19, wherein the second friction member is configured to threadably engage the attachment member.

21. A table assembly comprising the leg assembly of claim 17 and coupled to the table worksurface.

* * * * *